US005526597A

United States Patent [19]

Plotkin et al.

[11] Patent Number: 5,526,597

[45] Date of Patent: Jun. 18, 1996

[54] SELF AUTHENTICATING PICTORIAL WORK PRESENTATION SYSTEM

[75] Inventors: Theodore Plotkin, Riviera Beach; Andrew Plotkin, North Palm Beach; Greg Mirow, Delray Beach; Randy Matthews; Sandra Kohl, both of Jupiter; Rhonda Reynolds, Palm Beach Gardens, all of Fla.

[73] Assignee: Hibel Studio, Inc., Palm Beach Gardens, Fla.

[21] Appl. No.: 140,631

[22] Filed: Oct. 22, 1993

[51] Int. Cl.[6] ..... G09F 1/12

[52] U.S. Cl. ..... 40/722; 40/757; 40/768; 206/424

[58] Field of Search ..... 40/152, 152.1, 40/158.1, 124.1, 160; 206/424, 449

[56] References Cited

U.S. PATENT DOCUMENTS

| | | | |
|---|---|---|---|
| 1,381,762 | 6/1921 | Starr . | |
| 2,651,867 | 9/1953 | Prew | 40/152 |
| 3,161,975 | 12/1964 | McMillan | 40/152 |
| 3,274,721 | 9/1966 | Dreyer | 40/152 |
| 3,553,872 | 1/1971 | Ebner | 40/152 |
| 3,782,015 | 1/1974 | Esry | 40/152 |
| 3,787,992 | 1/1974 | Leonhardt | 40/152 |
| 3,985,230 | 10/1976 | Meyer et al. | 206/424 |
| 4,360,145 | 11/1982 | Wilcox . | |
| 4,598,825 | 7/1986 | Wiley et al. . | |
| 4,674,633 | 6/1987 | Steadman . | |
| 4,831,754 | 5/1989 | Tallent | 40/152 |
| 4,865,200 | 9/1989 | Sullivan et al. . | |
| 4,899,888 | 2/1990 | Shawler . | |
| 5,038,935 | 8/1991 | Wenkman et al. . | |
| 5,074,067 | 12/1991 | Cohart . | |
| 5,076,432 | 12/1991 | Wolf et al. . | |
| 5,103,972 | 4/1992 | Ackeret . | |
| 5,145,070 | 9/1992 | Pallett et al. . | |
| 5,161,827 | 11/1992 | Grosso . | |

*Primary Examiner*—Brian K. Green
*Attorney, Agent, or Firm*—Quarles & Brady

[57] ABSTRACT

A presentation system, by which a pictorial work can be protected in a manner appropriate for presentation as a gift or sales item and directly used by the recipient in a traditional manner without alteration and can be simultaneously authenticated in a manner that enhances the presentability of the work as a gift or sales item, preferably includes a framed pictorial work and an authenticating backing that bears authenticating information and is secured to the back of the frame. The system can further include a card and envelope with additional information relating to the work and a box having side flaps to hug the frame to give an appearance of extending the frame.

19 Claims, 2 Drawing Sheets

SELF AUTHENTICATING PICTORIAL WORK PRESENTATION SYSTEM

FIELD OF THE INVENTION

The invention relates to the authentication and presentation of art works and particularly to the authentication and presentation of two dimensional pictorial works.

BACKGROUND OF THE INVENTION

Art works, particularly two dimensional works such as paintings and drawings, have historically been objects of value and have been sold or given by their creators to others. With the advent of reproduction techniques, valuable works have been replicated, such as by offset lithography, to provide the benefits of the reproduced work to more than one recipient.

When an art work is reproduced in multiple copies, the opportunity for unauthorized copies of knockoffs to be produced increases significantly. One known practice for indicating and identifying copies of a work that are authorized by the creator or the owner of the original is the numbering of the copies in a limited series by the creator. However, this practice can also be fraudulently duplicated by others.

Authorized copies, such as lithographs, of popular and highly marketable works can be greatly appreciated as gift items to be received during birthdays, anniversaries, weddings, religious holidays or other gift giving times. It is therefore desirable to provide a pictorial work that readily indicates its authenticity. It is also desirable to provide such self authenticating work in an aesthetically pleasing manner appropriate for presentation as a gift item.

SUMMARY OF THE INVENTION

It is an object of the invention to provide a pictorial work presentation system that gives indicia of the authenticity of the work.

It is another object of the invention to provide a pictorial work presentation system that provides indicia of authenticity without alteration of the work itself.

It is yet another object of the invention to provide a pictorial work presentation system that provides indicia of authenticity that enhances the appearance and presentation value of the work, particularly as a gift item.

It is still another object to provide a pictorial work presentation system that is easy to assemble and thereby minimizes manufacturing costs.

These and other objects of the invention are achieved by a self authenticating pictorial work presentation system in which the pictorial work is enclosed in a suitable frame, the back of which is covered by a backing having indicia of authenticity on it. The indicia is preferably a certificate printed on the backing and, optionally, text relating to the creator of the work. The text can be biographical, and a photographic image of the artist can be provided on the backing. The backing can further bear a certifying signature or seal or both. The signature can be inked by an authorized officer of the publishers or the artist herself.

The authenticating backing is relatively permanently secured to the framing, such as by tacks or adhesives. Moreover, the authenticating backing can be further secured to the frame by fasteners for hanging wire. The fasteners, such as screws, can be inserted through the backing into the framing.

The secured work is enclosed in an authenticating casing that is appropriate for hanging or other display and at the same time is arranged for presentation as a gift or as a sales item in a retail store or catalog.

The encased work can be enclosed in a gift box, preferably constructed to provide sidewall flaps that closely engage the framing in hugging manner, whereby the flaps appear as an extension of the framing and can be arranged to further enhance the presentation appearance of the work. To even further promote the work as a gift item, the system can include a card and envelope set, in which the card or envelope preferably includes a depiction of the work or another work of the artist.

Thus, the invention provides a system by which a pictorial work can be encased and protected in a manner appropriate for presentation as a gift or sales item and directly used by the recipient in a traditional manner without alteration and can be simultaneously authenticated in a manner that enhances the presentability of the work as a gift or sales item.

BRIEF DESCRIPTION OF THE DRAWINGS

The following detailed description of embodiments of the invention is made with reference to drawings whose illustrations aid in an understanding of the invention. Among the drawings.

DETAILED DESCRIPTION OF EMBODIMENTS OF THE INVENTION

The invention is directed to a pictorial work presentation system that assists in authenticating the work in an aesthetically pleasing manner to enhance the presentation appearance and value of the work as a gift item. While it is a primary object of the invention to provide the described features for gift giving purposes, it is not intended that the scope of the invention be limited to works that are given away; "gift" is not intended in a legal sense but rather in a socio-cultural sense. The structure of the invention has application in other transactional settings, including retail and catalog sales environments, in which aesthetic appearance is also important.

Figures 1, 4:
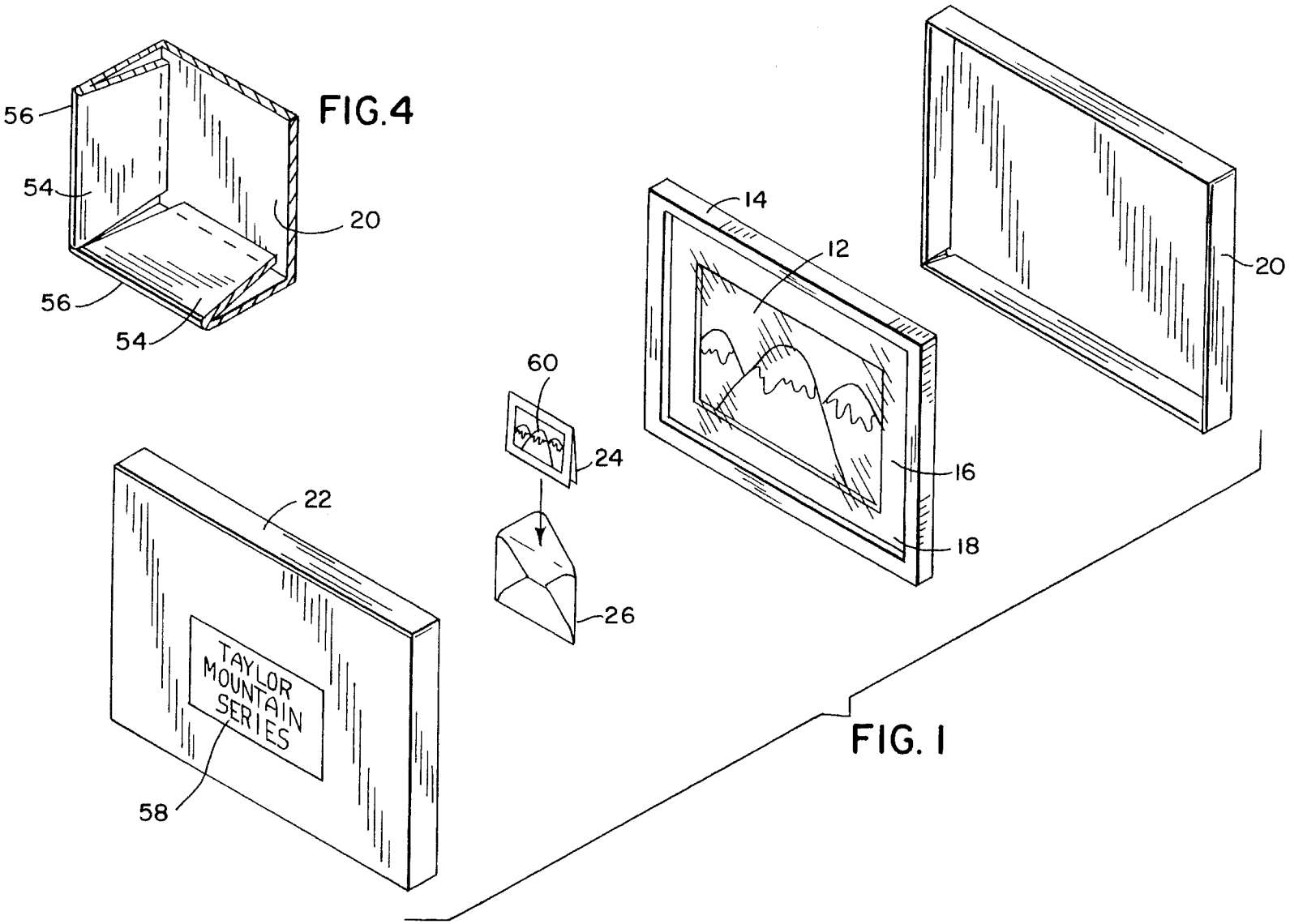
FIG. 1 shows a front perspective view of an embodiment of the presentation system for a pictorial work in accordance with the invention.
FIG. 4 is a sectional perspective view of a box corner used in an embodiment of the invention.

Referring to the figures and first to FIG. 1, the presentation system includes a pictorial work, such as a lithograph 12, mounted in a frame 14. The system can also provide matting 16 and other ornamental additions that may be appropriate to the particular work involved, as determined in accordance with the subjective choices of the producer or the recipient. The invention is primarily directed to the presentation of two dimensional pictorial works, including but not limited to, paintings, drawings, lithographs, serigraphs, reproductions, etchings, photographs and collages.

Figure 3:
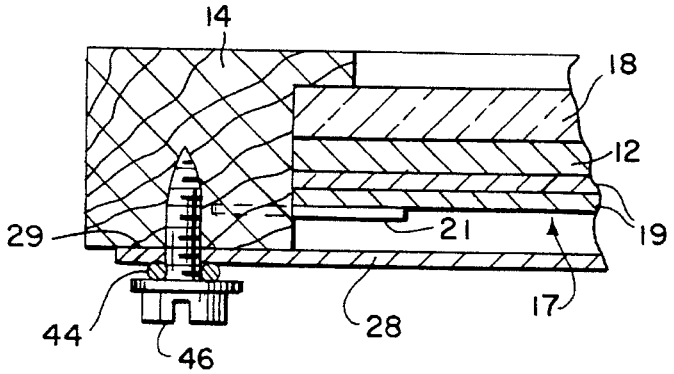
FIG. 3 is a sectional view taken along line 3—3 in FIG. 2.

Any frameable medium is contemplated by the invention. The invention also has application to three dimensional works that have a relatively small thickness dimension, such as collectors' plates and bas reliefs. The framed lithograph 12 is preferably covered by a glass sheet 18. As shown in FIG. 3, the lithograph 12 can be inserted through a rear opening 17 in a conventional manner and be backed by internal backing 19 held by pins 21.

The framed lithograph 12, the glass sheet 18, the matting 16, the internal backing 19 and any other inserts provided for the presentation system can be configured to uniform dimensions so that the group can be quickly inserted in the frame 14. As a result, time, labor and expense can be reduced.

The framed lithograph 12 can be enclosed in a gift box 20 and lid 22. The system can further include a card 24 and an envelope 26 to enhance the presentability of the lithograph 12 as a gift.

Figure 2:
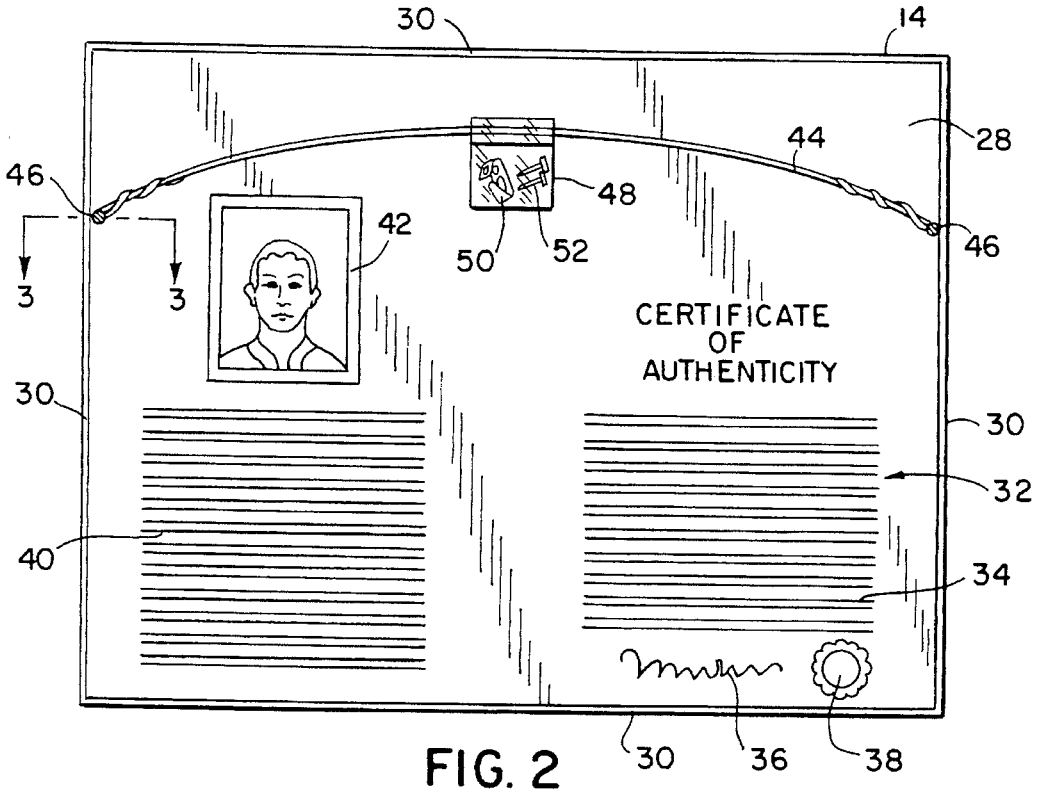
FIG. 2 is a rear elevational view of an embodiment of the presentation system for a pictorial work according to the invention.

Referring to FIG. 2, the lithograph 12 is encased in the frame 14 by an authenticating backing 28 that is secured to the back sides 30 of the frame 14 so as to cover the rear opening of the frame 14 into which the lithograph 12 was previously inserted. The authenticating backing 28 provides textual information 32 relating to the lithograph 12. Preferably, the textual information 32 includes a certification or verification 34 that the encased lithograph 12 is authentic. Authentic in this context means that the encased work is the original or is a reproduction, such as the lithograph 12, of the original, authorized by the creator or owner of the original. The authentication or certification 34 can further include a signature 36 or a seal 38 or both. The signature 36 can be inked or printed. The textual information 32 is preferably printed on the medium of the authenticating backing 28, but alternatively, the textual information 32 can by printed on a sticker that is applied to an authenticating backing substrate, which is in turn secured to the frame 14. The medium of the authenticating backing 28 or the printing on the authenticating backing 28 can be provided with identifying indicia such as a water mark or a particular dye color so that a legitimate backing cannot readily be imitated accurately.

The textual information 32 preferably also includes information 40 about the artist that created the encased lithograph 12. The information 40 can be biographical, and a photographic image 42 of the artist can be provided on the backing. This information 40 can enhance the gift presentation appearance and value of the system.

To further secure the authenticating backing 28 to the frame 14 and to provide a convenient means for mounting the encased lithograph 12, a hanging wire 44 can be secured by fasteners, such as machine or sheet metal screws 46. Referring to FIG. 3, each machine or sheet metal screw 46 can be inserted through the authenticating backing 28 into the frame 14 to further secure the authenticating backing 28 to the frame 14. The sheet metal screw can provide a flange, thereby reducing the number of parts necessary for assembly and associated costs.

The authenticating backing 28 is preferably secured to the frame 14 by adhesives 29. Alternatively, the authenticating backing 28 can be secured by tacks or other known fasteners that relatively permanently secure the backing to the frame.

A packet 48 containing hanging brackets 50 and nails 52 can also be secured to the hanging wire 44 so that the system is fully equipped for hanging by the recipient.

Figure 5:
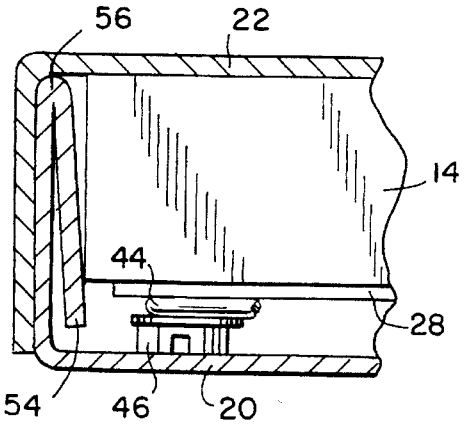
FIG. 5 is a sectional view through the side of an embodiment of the presentation system according to the invention in a closed configuration.

Referring to FIG. 4, the gift box 20 is preferably constructed to provide sidewall flaps 54 that closely engage the frame 14 in hugging manner, whereby the flaps 54 appear as an extension of the frame 14 and can be arranged to further enhance the presentation appearance of the lithograph 12. The sidewall material can extend from the open edge 56 and fold back as a flap 54 so as to be biased inwardly. Referring to FIG. 5, when the encased lithograph 12 is inserted in the gift box 20, the biased flaps 54 can closely engage the frame 14, whereby the flaps 54 present extensions of the frame 14 in a frontal view of the system.

Referring again to FIG. 1, the gift box lid 22 can include further information 58 about the enclosed lithograph 12 or other labeling to further enhance the gift appearance of the system. The further information 58 can be the artist's name, the name of the work, the name of the series to which the work belongs or other identifying information. The enclosed card 24 or the envelope 26 can also include further information 60 relating to the lithograph 12, such as a reduced sized depiction of the encased lithograph 12 or of another work of the artist that created the encased lithograph 12. Alternatively, the further information 58 placed on the lid 22 can be used again.

Although a description of embodiments, including embodiments presently considered best, has been given with particular attention to details, this description is not to be construed as limiting the scope of the invention. Many variations and modifications can now occur to those skilled in the art in view of this disclosure. Accordingly, the scope of the invention should not be determined by the above description, but rather by a reasonable interpretation of the appended claims.

What is claimed is:

1. A pictorial work presentation system, comprising:

a pictorial work created by an artist;

a frame peripherally surrounding said work and having a front opening to permit viewing of a front side of said work, said frame having back sides that define a rear opening of said frame;

a gift box, said gift box having an open face, a plurality of gift box sides and a lid, said frame resting in said gift box and said lid covering an open side of said gift box wherein each of said plurality of gift box sides have portions that angle toward said frame from said open side of said gift box, whereby said angled side portions substantially present an image that said angled side portions form a secondary framing around said frame, thereby enhancing the aesthetic appeal of the presentation system, wherein said angled side portions are flaps extending from sidewalls of said gift box, said flaps being intrinsically biased toward said frame; and a backing secured to said back sides of said frame and covering said rear opening, said backing bearing a certificate of authenticity of said work.

2. The presentation system according to claim 1, wherein said certificate includes a signature.

3. The presentation system according to claim 2, wherein said signature is inked on said authenticating backing.

4. The presentation system according to claim 1, wherein said backing further includes textual information relating to said work.

5. The presentation system according to claim 4, wherein said textual information includes a biographical statement about the artist of said work.

6. The presentation system according to claim 1, wherein said backing further includes pictorial information relating to said work.

7. The presentation system according to claim 1, wherein said authenticating backing is adhered to said backsides of said frame.

8. The presentation system according to claim 1, further comprising a hanging line and a fastener attached at each end of said hanging line, said fasteners connecting to said frame sides through said authenticating backing.

9. The presentation system according to claim 8, wherein the fasteners are sheet metal screws, said sheet metal screws being screwed into said frame sides through said authenticating backing.

10. The presentation system according to claim 1, wherein said pictorial work is substantially two dimensional.

11. The presentation system according to claim 1, wherein said pictorial work is three dimensional.

12. The presentation system according to claim 1, wherein said pictorial work is a painting.

13. The presentation system according to claim 1, wherein said pictorial work is a photograph.

14. The presentation system according to claim 1, wherein said pictorial work is a limited edition.

15. The presentation system according to claim 1, wherein said pictorial work is a reproduction.

16. The presentation system according to claim 1, wherein said pictorial work is a lithograph.

17. The presentation system according to claim 1, wherein said pictorial work is a serigraph.

18. The presentation system according to claim 1, wherein said pictorial work is an etching.

19. The presentation system according to claim 1, further comprising a gift card and an envelope resting in said gift box, at least one of said gift card and said envelope bearing additional information relating to said pictorial work.

* * * * *